United States Patent [19]

Waleckx

[11] 3,972,172

[45] Aug. 3, 1976

[54] SPINNING ROTOR CONSTRUCTION

[75] Inventor: Jean Waleckx, Villebon-sur-Yvette, France

[73] Assignee: SKF Compagnie d'Applications Mecaniques, Clamart, France

[22] Filed: Mar. 11, 1975

[21] Appl. No.: 557,383

[30] Foreign Application Priority Data

Mar. 14, 1975 France ..... 75.08654

[52] U.S. Cl. ..... 57/58.89; 57/92

[51] Int. Cl.[2] ..... D01H 1/12

[58] Field of Search ..... 57/58.89–58.95, 57/92, 129, 130

[56] References Cited

UNITED STATES PATENTS

| | | | |
|---|---|---|---|
| 3,119,223 | 1/1964 | Meimberg | 57/58.95 X |
| 3,324,642 | 6/1967 | Meimberg et al. | 57/58.95 |
| 3,481,128 | 12/1969 | Landwehrkamp et al. | 57/58.89 |
| 3,699,766 | 10/1972 | Archambault | 57/58.91 |
| 3,798,887 | 3/1974 | Le Chatelier | 57/58.89 |

*Primary Examiner*—John Petrakes

*Attorney, Agent, or Firm*—Haseltine, Lake & Waters

[57] ABSTRACT

A spinning rotor for free fibers having axial extraction and a rotatable depending hollow shaft secured thereto and provided with two grooves receiving two rows of balls mounted in cylindrical cages and disposed in fixed exterior rings having oblique contact surfaces. These exterior rings are mounted in the bore of a bearing support and are maintained in spaced relation by a cross-piece of U-shape and an elastic washer, the cross-piece being axially and rotatably immobilized in the bearing support by a clamp or similar element.

9 Claims, 2 Drawing Figures

SPINNING ROTOR CONSTRUCTION

FIELD OF THE INVENTION

The invention relates to spinning machines of the type known as free fiber machines or open end machines which comprise spinning rotors having high rotational speeds and constituted by a rotatable bowl having an inlet at which the free fibers are introduced and an outlet at which formed and twisted fiber is removed, the outlet being at the opposite side across the axis of the rotor.

BACKGROUND

Rotors of the above type must turn at very high speeds of 25,000 to 60,000 RPM, which poses very serious problems for the construction of the support bearings. There are generally utilized ball bearings of small size whose interior ring or race is mounted on a fixed hollow axle for the rotor and whose exterior ring is mounted in a bore of the rotor, such that the rows of balls and their cages rotate at a very high speed and are subjected to a substantial centrifugal force which produces deformations and abnormal wear. Furthermore, the chamber containing the rotor is subjected to a suction, necessary to the process, but which has the disadvantage of aspirating, through the ball bearing, external dust which fouls and causes wear of the ball bearing. In order to avoid this entry of dust, these rollers are generally lubricated by means of an oil mist under pressure, but then a substantial part of the oil is found on the fiber filaments while the remainder is evacuated into the suction source. By maintaining the bearing chamber under pressure a great consumption of air is effected. Finally the rotor is driven by a belt whose tension produces a constant force on the same side of the interior ring of the bearings which constitutes a condition of use which is unfavorable and rapidly leads to wear of the bearing.

SUMMARY OF THE INVENTION

An object of the invention is to eliminate the above-noted disadvantages by the provision of a rotor whose hollow axle is fixed but whose bearings have interior races which are moveable and fixed exterior races while additionally the bearings are protected from entry of dust from the exterior of the bearing without the need for a particular type of lubrication system nor under any particular pressure.

The invention contemplates fixedly mounting the the rotor on a hollow axle containing a fixed sleeve and supporting the axle in a bearing having oblique contact surfaces, the two exterior races or rings of the bearing being axially spaced after mounting and maintained at the spacing by a cross-piece of U-shape and an elastic washer. These exterior rings as well as the cross-piece are mounted in the bore of a fixed support member and axially and rotatably maintained solely by immobilization of the cross-piece.

The hollow rotatable axle is additionally traversed coaxially by the fixed sleeve, this sleeve having being subjected to no force whatsoever. The sleeve in turn is secured with the base of the support member which in turn is mounted in a clamp having branches with facing ends in spaced relation, said branches being provided with bores providing both elasticity therefore and air passageways so that the two end faces of the clamp are subjected to atmospheric pressure.

Baffles are provided on the upper face of the bearing at the base of the rotor and the lower face of the bearing at the top of the drive pulley fixed to the lower extremity of the hollow shaft and the space thus defined between the support member and the bearing assembly can be lubricated by any means whatsoever via a tube passing between the branches of the clamp and through the support member.

To avoid all pressure leakage, the base of the rotor is additionally encircled by sealing washer mounted frictionally on the lower cover of the suction chamber.

Other features of the invention will appear from the following description of an embodiment given by way of example and illustrated in the attached drawing.

DETAILED DESCRIPTION

Figure 1:
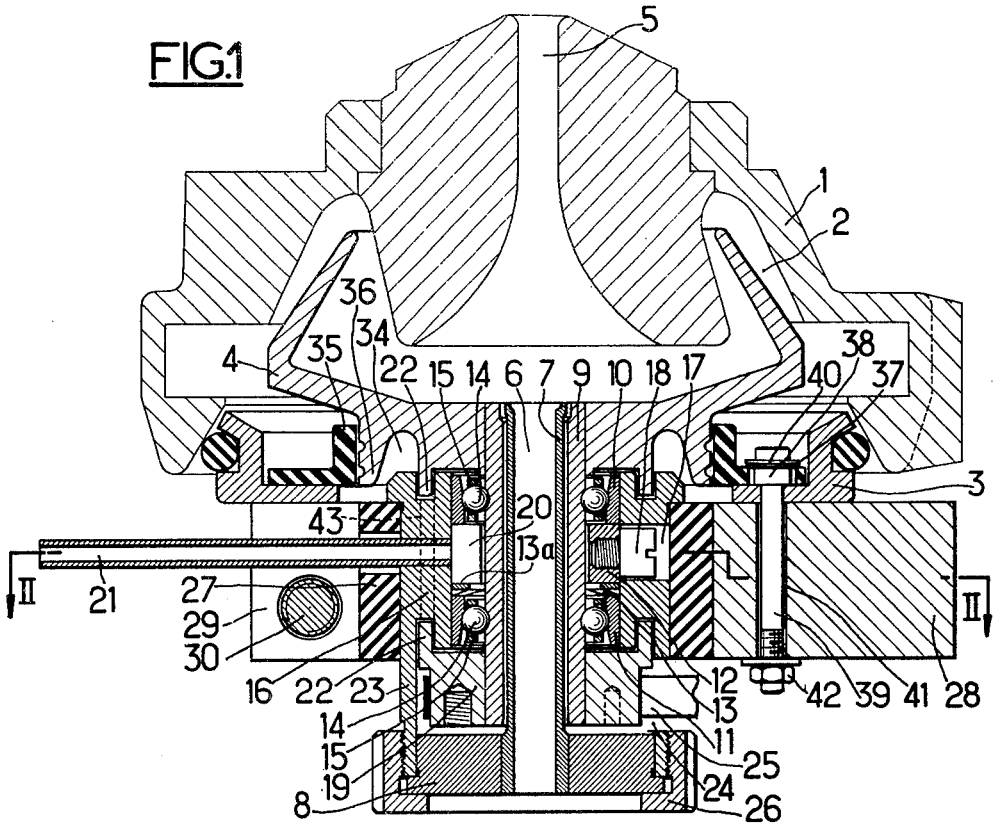
FIG. 1 is a vertical section taken along line I—I in FIG. 2.

There is shown in FIG. 1 a fixed housing 1 of a chamber 2 subjected to suction through a conduit (not shown) and closed by a lower removable cover 3. In the chamber 2 there is mounted a spinning rotor 4 of conventional form, in which fibers arrive at the upper part through an inlet 5 and these fibers are divided towards the inner periphery of the rotor under the effect of a current of air traveling from bottom to top through the central hole 6 under the effect of the suction and meet a descending current of air traveling through the orifice 5. The filament formed by the progressive collection and the twisting of these fibers is continuously removed at the base through the orifice 6.

Contrary to the conventional arrangement, the orifice 6 is not mounted in a fixed axle of the rotor, but, in contrast, in a sleeve 7 which is fixed at its base in a disc 8 and which is substantially without contact with the rotatable part. The sleeve can therefore have a relatively thin wall since there is no mechanical force to resist. The rotatable part comprises in addition to the rotor 4, a tubular axle 9 in which are directly formed two grooves constituting the interior races of ball-bearing rollers. These rollers are of the annular disposition type having oblique contact which requires that when mounting exterior rings 10 and 11, these initially are between the rows of balls and are pushed outwardly to enclose the rows of balls. After mounting the two external rings 10 and 11 at their specified spacing, there can be interposed between them a cross-piece 12 shown in particular in FIG. 2, and having a U-shape form which encircles the hollow axle 9. The cross-piece 12 serves as a bracing member and directly bears against the lower surface of the upper ring 10 and indirectly on the upper surface of the lower ring 11 through the intermediary of an elastic washer 13 and a plate washer 13*a* preliminarily placed into position. The washer 13*a* prevents one of the undulations of the spring washer 13 from coinciding with the opening between the branches of the U-shape cross-piece 12.

This particular type of mounting permits the utilization of rows of balls 14 mounted in cylindrical roller cages 15 which are formed in one piece and possess excellent resistance to centrifugal force. At the same time, the elastic washer 13 constantly takes up all play of the roller assembly.

The assembly of the two rows of balls and the cross-piece 12 is then introduced with a minimum of play in the central bore of a support element 16 completing the bearing and having a small transverse bore 17 in which there is introduced a screw 18 which is threaded in a tapped hole in the cross-piece 12. This axially locks the cross-piece 12 without deforming it, cross-piece 12 being a member of great precision. As a consequence of axial locking of cross-piece 12, the two exterior rings 10,11 of the rollers are also axially immobilized. The screw 18 is introduced with play in the bore 17 in order to avoid bending of the cross-piece 12. This space is then taken up by filling it with a thermofusible material such as sealing wax. After the mounting of the hollow shaft 9 in the bearing there is then mounted on a lower projecting extremity of shaft 9 a drive pulley 19, for example, by fixing the pulley on said extremity.

The screw 18 also presents the advantage of immobilizing the cross-piece 12 in rotation such that the cavity 20 formed in the bore of the bearing at the lateral opening between the branches of the cross-piece can be fed with lubricant by means of a tube 21 opening through the wall of the support element 16 into cavity 20. The tube 21 permits the lubrication of the roller bearings by any suitable means such as an oil spray of low pressure from an oil container, or grease. The lubricant is retained by means of baffles at the top and bottom of the bearing respectively formed by circular skirts 22 integral with the rotor 4 and the pulley 19, the skirts penetrating into corresponding circular recesses in the support 16.

The support 16 is formed at the bottom with a tubular prolongation 23 provided with a large slot 24 for the passage of the belt 25 and prolongation 23 is terminated by a threaded portion on which a screw 26 is threaded to lock the disc 8 supporting the sleeve 7.

Figure 2:
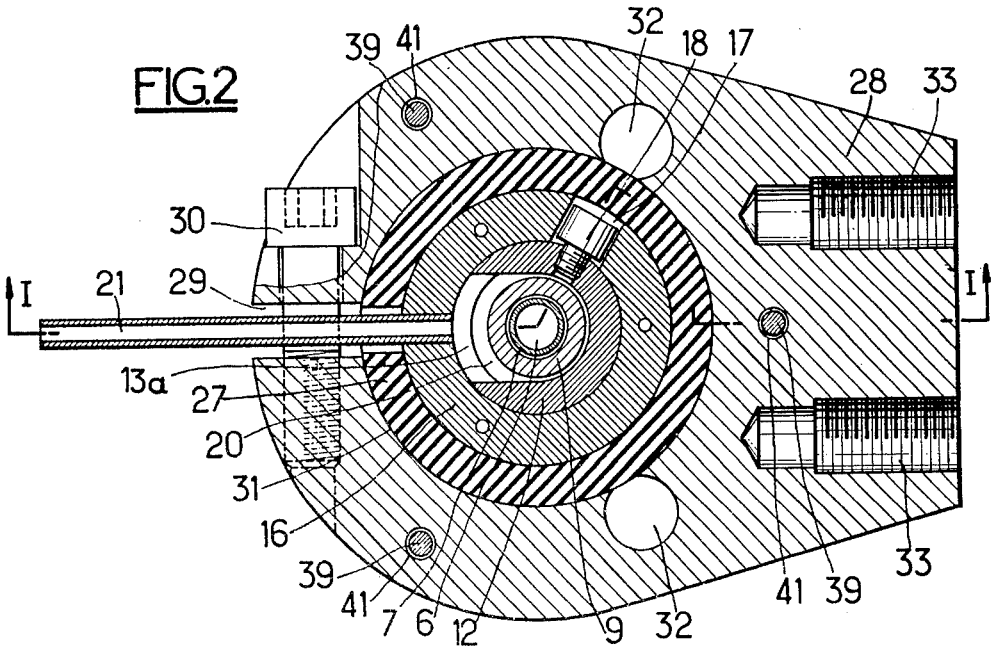
FIG. 2 is a horizontal section taken along line II—II in FIG. 1.

The bearing assembly is mounted through the intermediary of an elastic ring 27, for example of rubber, in a clamp 28, shown particularly in FIG. 2 and having branches whose facing ends are spaced apart to form a slot 29. This allows the engagement of the bearing assembly and its lockage therein by means of a screw 30. The slot also permits the passage of the tube 21. The clamp further has a bore 31 which allows passage of the nut 26 and then the reception of the elastic ring 27. The clamp also has bores 32 providing elasticity for the branches of the clamp. The assembly of the rotor and its bearing can then be mounted and dismounted very rapidly in the clamp 28 for maintenance, control, replacement, or repair, this clamp being fixed, by means of threaded holes 33, in a pivotal support of conventional type including the return drive pulley for the belt 25.

The opening or slot 29 of the clamp, and the bores 32 are additionally furnished to provide a large communication passage between the lower face of the clamp and the annular space 34 situated at the base of the rotor above the support 16 and at the interior of the lower cover 3, so that this space will constantly be at atmospheric pressure in order to avoid all passage through the bearing assembly of a current of air under the effect of the suction. This space 34 is sealed from the interior of the cavity 2 by means of a sealing ring 35. The ring 35 is adjustably mounted at the periphery of the base 36 of the rotor and is formed with grooves defining baffles, ring 35 being frictionally mounted by means of elastic washers 37 applying it onto the cover 3 while permitting automatic lateral adjustment due to the existence of large play between the head 38 of mounting bolts 39 and corresponding holes formed in the ring 35. The elastic washers 37 can themselves be fixed to the heads 38 by means of circlips 40. Finally the bolts 39 which also serve to secure the cover 3 on the clamp 28 pass through holes in cover 3 with a minimum of play then traverse the clamp through the much larger bores 41 therein to permit the deformation movements of the clamp at the time of its engagement with the bearing. The nuts 42 are then threaded onto the lower end of the bolts to lock the same.

Due to this arrangement there is a low loss of suction which is particularly advantageous and additionally it permits, due to the large exposure to the atmosphere, the two extremities of the support 16 to have no flow of air through the roller bearing assembly. To increase the precaution there can also be provided bores 43 establishing communication between the two circular recesses in the support 16 receiving the two skirts 22 in order to insure a still better equilibrium of the pressure on the two faces. Due to this disposition there can be therefore utilized as has been previously indicated, any lubrication means whatsoever to establish a pressurization at the interior of the bearing.

Finally, thanks to the more efficient mounting with the fixed external rings and the rotatable internal ring, the load corresponding to the tension of the belt 25, does not run the risk of always being applied on one side of the shaft 9 since this shaft rotates and the exterior rings 10,11 better resist the contact pressure and the wear due to their concavity and their more substantial surface area. The annular disposition of the oblique contact with elastic take-up of the play also provides clear improvement of performance and a better stability of the rotor. Finally the drive speed in rotation of the rings, ball-bearings and the cages will be reduced with respect to the conventional disposition. Thanks to all of the improvements, the rotor according to the invention is extremely simple in fabrication, maintenence, and demounting and presents the advantage of a much reduced wear even at speeds of rotation up to 60,000 RPM.

I claim:

1. A spinning rotor for free fibers having axial fiber extraction, said rotor comprising a hollow rotatable shaft provided with two spaced external annular grooves, two rings of balls mounted in cylindrical cages, said balls being rotatably disposed in said grooves, fixed exterior rings having oblique contact surfaces engaged with said balls, a bearing member having a bore receiving said exterior rings, bracing means in said bore maintaining said exterior rings in said bore in spaced relation, and means for axially and rotatably immobilizing said bracing means, which bracing means comprises a U-shaped cross-piece encircling said shaft and an elastic washer between said cross-piece and one of said exterior rings.

2. A rotor as claimed in claim 1 comprising a fixed sleeve within said hollow rotatable shaft in spaced relation therewith, and means fixedly connecting said sleeve to said bearing member.

3. A rotor as claimed in claim 1 wherein said means for axially and rotatably immobilizing said bracing means comprises a clamp including branches lockably embracing said bracing means, said branches having facing ends which are spaced from one another, and a locking screw engaging said branches to clamp the same around said bracing means, said branches having through holes to provide elasticity therefor, and also passages for air flow therethrough.

4. A rotor as claimed in claim 3, wherein said U-shape cross-piece defines a cavity within the bore of said bearing member, said rotor further comprising a lubrication tube passing between said facing ends of the clamp and through the bearing member to open into said cavity.

5. A rotor according to claim 3, wherein means for axially and rotatably immobilizing said bracing means further comprises a fastener threaded into said cross-piece and having a projecting head, said bearing member having a recess in which said head is received with play.

6. A rotor according to claim 5, comprising a thermo-fusible material in said recess taking up said play.

7. A rotor according to claim 4, wherein said rotor shaft is vertically oriented and said rings of balls are spaced above one another, said rotor further comprising a drive pulley fixed to said rotatable shaft at the lower end thereof, said bearing member having upper and lower ends with circular grooves provided therein respectively facing said rotor and said pulley, and circular skirts on said rotor and pulley extending into the facing grooves to form sealing baffles for lubricant introduced into said cavity by said lubrication tube.

8. A rotor as claimed in claim 7, wherein said bearing member is provided with a bore directly connecting said circular grooves.

9. A rotor as claimed in claim 7, wherein said bearing member includes a lower projecting portion surrounding said drive pulley and provided with a slot for the passage of a belt on the pulley, a fixed sleeve within said hollow rotatable shaft in spaced relation therewith, and means engaging said projecting portion of the bearing member for securing said sleeve therewith.

* * * * *